United States Patent [19]

Bloom

[11] 4,274,160

[45] Jun. 23, 1981

[54] UNIFORM CAP

[75] Inventor: Bernard Bloom, Chicago, Ill.

[73] Assignee: Midway Cap Company, Chicago, Ill.

[21] Appl. No.: 873,351

[22] Filed: Jan. 30, 1978

[51] Int. Cl.[3] ..... A42B 1/02

[52] U.S. Cl. ..... 2/195

[58] Field of Search ..... 2/195, 63, 199, 171, 2/171.1, 180, 179, 175; 403/329, 107, 109; D2/244

[56] References Cited

U.S. PATENT DOCUMENTS

| | | | |
|---|---|---|---|
| 1,481,981 | 1/1924 | Boye | 403/107 |
| 2,154,210 | 4/1939 | Lev | 2/195 |
| 2,160,513 | 5/1939 | Pasternak | 2/195 |
| 2,341,233 | 2/1944 | Norton | 403/107 X |
| 2,389,689 | 11/1945 | Scheppler | 2/195 |
| 2,450,284 | 9/1948 | Lev | 2/195 |
| 2,455,686 | 12/1948 | Lev | 2/195 |
| 2,536,134 | 1/1951 | Lev | 2/195 |
| 2,575,114 | 11/1951 | Lev | 2/195 |
| 2,686,919 | 8/1954 | Schlesinger | 2/195 |
| 2,822,549 | 2/1958 | Glass et al. | 2/195 |
| 3,488,777 | 1/1970 | Bloom et al. | 2/195 |
| 3,999,663 | 12/1976 | Walter et al. | 403/107 X |

FOREIGN PATENT DOCUMENTS

| | | | |
|---|---|---|---|
| 963991 | 7/1950 | France | 2/195 |

*Primary Examiner*—Werner H. Schroeder
*Assistant Examiner*—Andrew M. Falik
*Attorney, Agent, or Firm*—Wegner, Stellman, McCord, Wiles & Wood

[57] ABSTRACT

A uniform cap having a frame over which is fitted a flexible cover with a hollow tubular grommet to distend the cover includes a removable molded plastic stay upstanding from the front of the frame to maintain the grommet at a fixed elevation and to support a badge or insignia at the front of the cover. The stay includes various connectors for attaching the grommet to the stay depending on the size of the grommet and the height of the cap.

1 Claim, 8 Drawing Figures

FIG. 1
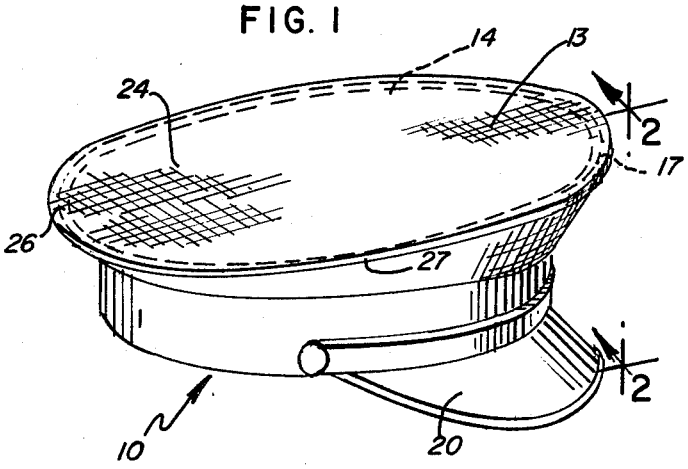
FIG. 2
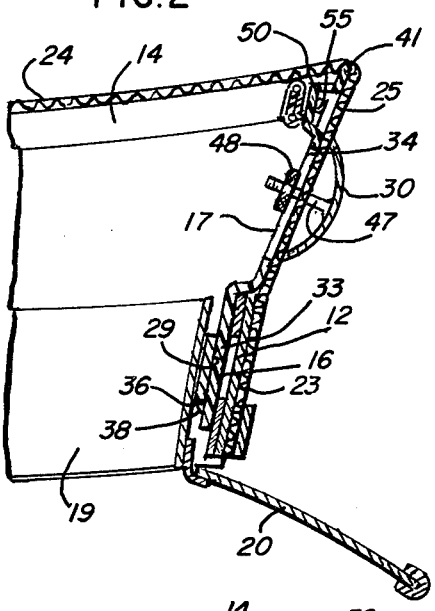
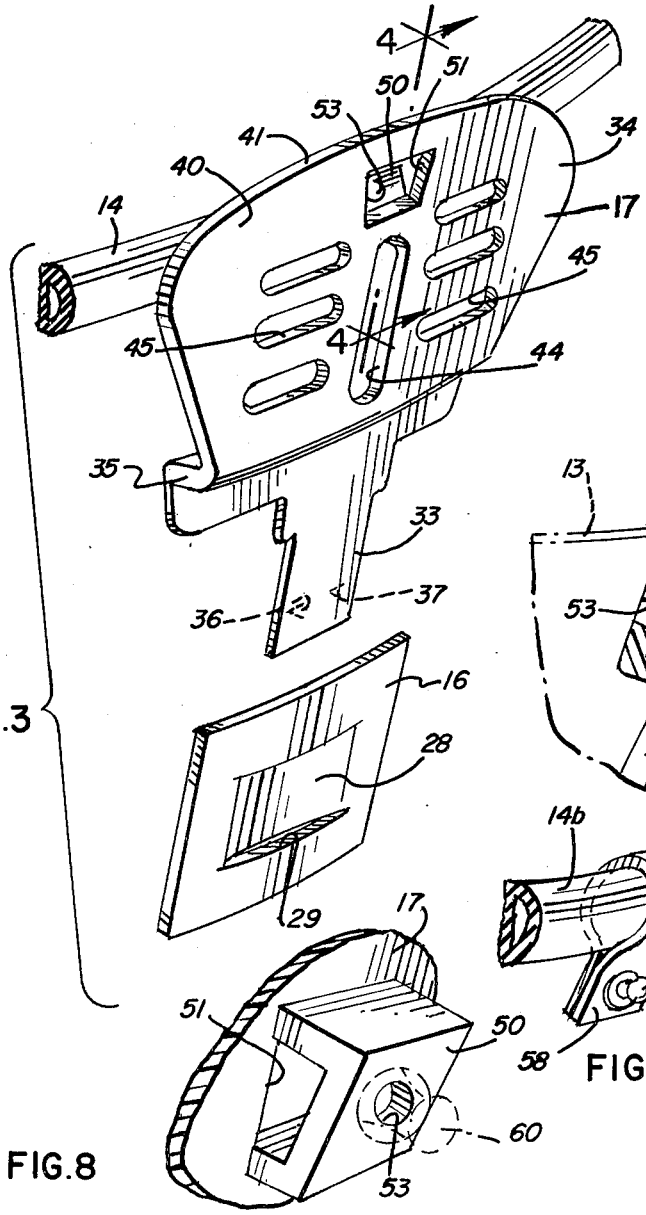
FIG.3
FIG.8
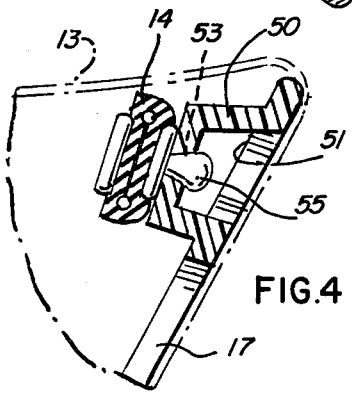
FIG.4
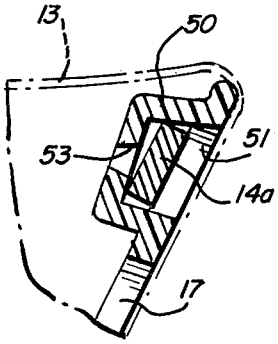
FIG. 5
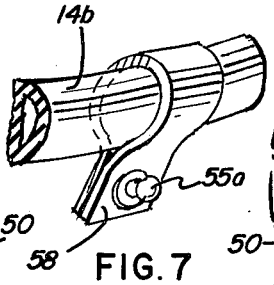
FIG. 7
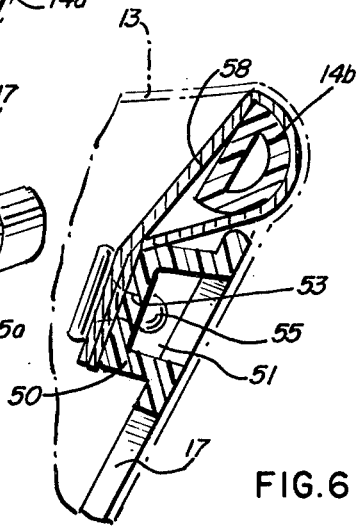
FIG.6

UNIFORM CAP

BACKGROUND OF THE INVENTION

This invention relates to a uniform cap having a frame and a grommet for distending a flexible cover and, more particularly, to a stay for supporting badges and the like and means for connecting different types of grommets to such a stay in caps of different size.

Various means have been devised for attaching a distending band or grommet to a stay which is upstanding from the frame of a uniform cap and to which badges or insignia may be affixed. The circular grommet is flexible and resilient and tensions the top of the cap cover. The stay maintains the grommet at a fixed elevation at the front of the cap and rigidly supports the attached badge or insignia in proper position. One such construction is illustrated in my prior U.S. Pat. No. 3,488,777 issued Jan. 13, 1970.

In such prior art constructions of this type, the stay dimensions and, hence, the construction of the stay must be changed whenever the design of the cap is modified. In particular, where the height of the cap is changed or the size of the grommet is changed to modify the curve at the top edge of the cover, a different stay must be employed.

SUMMARY OF THE INVENTION

It is therefore a principal feature of the invention to provide a stay and badge or insignia support which may be used in uniform caps of various designs.

In accordance with the invention, a stay includes a connecting portion, which may be inserted into a holder fixed to the cap frame, and a mounting portion, which has at least one slot for receiving a badge or insignia. The mounting portion has a raised loop portion defining a slot through which a grommet may pass and has means for receiving a releasable snap connector which may be carried by the grommet. Small grommets pass through the loop slot, while larger grommets are connected to the stay by the snap connector.

The grommet in one embodiment is provided with a male snap connector that engages a mating aperture defined in the loop portion of the stay. In an alternative embodiment, the male snap connector is fixed to the loop portion and engages a female snap connector secured to the grommet.

In a cap having a high top, the grommet carries a relatively rigid strap which extends downwardly to a point adjacent the stay loop portion. The strap has a releasable connector portion which mates with a connector portion carried by the loop portion, so as to maintain the grommet in fixed relation above the stay. Thus, the stay employed is the same regardless of the height of the cap.

BRIEF DESCRIPTION OF THE DRAWINGS

FIG. 1 is a perspective view of a uniform cap of the general type to which the invention applies;

FIG. 2 is a fragmentary central vertical section through the front portion of the cap taken along line 2—2 of FIG. 1;

FIG. 3 is an enlarged fragmentary, exploded perspective view, looking from the front, showing the grommet, the supporting stay, and the holder therefor;

FIG. 4 is an enlarged cross-sectional view of the grommet and stay taken along line 4—4 of FIG. 3 showing the snap connection between the grommet and stay with the cap cover indicated in phantom;

FIG. 5 is an enlarged cross-sectional view similar to FIG. 4, but showing a relatively small grommet passing through the loop portion of the stay;

FIG. 6 is an enlarged cross-sectional view similar to FIGS. 4 and 5, but showing a relatively high cap with a strap connecting the grommet and stay;

FIG. 7 is a fragmentary perspective view showing the relationship of the grommet and strap utilized in the cap of FIG. 6; and FIG. 8 is an enlarged rear perspective view of the loop portion of the stay, but showing, in phantom, a male snap connector which may be optionally carried thereby.

DESCRIPTION OF THE PREFERRED EMBODIMENT

In the embodiment of the invention shown in the drawings, a uniform cap, generally designated 10, includes a conventional endless band or frame 12, a flexible cloth cap cover 13, a resilient grommet 14, a holder 16, and a stay 17 which acts as an insignia and badge support.

The frame 12 is made of fiber, plastic or the like. The frame 12, which optionally is fabric covered, also includes an inner sweatband 19 and a forwardly extending visor 20. The cap cover 13 includes a lower portion 23 which is adapted to be fitted around the frame 12, a circular top portion 24 and an intermediate portion 25 connecting the lower and top portions 23 and 24. Cover 13 may be removable from or permanently affixed to the cap frame.

The grommet 14 is hollow and had a D-shaped cross-section. A plug 26 is inserted into the open ends of the grommet 14 to join the ends together and render the grommet an endless ring. The grommet 14 is fitted within the cap cover 13 at the top end thereof and extends circumferentially to exert outward pressure on the curved peripheral edge 27 and the top portion 24 of the cap cover 13. The endless resilient grommet 14 is made of a suitable rubber-type material which is both flexible and resilient and is effective in maintaining the cap cover 13 in a smooth distended condition.

The holder 16 is a relatively thin rectangular plate, preferably made of plastic, which is sewn or otherwise affixed to the frame 12. The holder 16 may be transversely bowed to conform to the curve of the frame 12 and includes a bowed bar 28 which is disposed so as to lie in spaced relation from the concave rear surface of the holder plate and define a vertical slot 29.

The stay 17 maintains the grommet 14 in spaced relation at a fixed elevation above the frame 12 and provides a support for an insignia or badge 30, as will hereinafter be described. The stay 17 is preferably formed from plastic as by molding and includes a bowed connecting tab portion 33 and an enlarged mounting portion 34 forwardly offset from the tab portion 33 via segment 35. The tab portion 33 is thin and elongate and is of a size and configuration to be inserted through the slot 29 defined by the bar 28 raised from the holder 16. Because the stay 17 and the holder 16 are both formed from plastic, there is relatively little friction to prevent relative motion. However, to prevent the tab portion 33 from being withdrawn accidentally from the holder slot 29, a pair of projections 36 and 37 are raised from the rear surface of the tab portion 33 and are provided with cam surfaces 38 to aid in the insertion thereof into the holder slot 29.

The mounting portion 34 has a slight forward inclination and is arcuately formed to provide a convex forward surface 40 generally corresponding to the front part of the cap cover intermediate portion 25 and has an arcuate top edge 41 which conforms with the top portion of the cap cover 13. Formed in the mounting portion 34 are a central vertical slot 44 and a series of horizontal slots 45 on either side of the vertical slot 44. The slots 44 and 45 provide means for attaching insignia or badges 30 to the cap. The insignia or badges 30 generally have a screw threaded stem 47 which extends rearwardly through the cap cover and the mounting portion slots. A retaining button or knurled nut 48 on the inside of the cap is then screwed onto the stem 47 to fasten and hold the badge in the desired place in the slot 44 or 45. The large number of slots permits the badge to be laterally and vertically adjusted relative to the cap and also provides means for mounting double post insignia.

Adjacent the top edge 41 of the mounting portion 34 is a loop portion 50 which defines a laterally extending slot 51 with the mounting portion 34. The loop portion 50 has an aperture 53 formed therein which is adapted to receive a male snap connector 55 carried by the grommet 14.

The grommet 14 may be constructed so as to have a cross-sectional diameter which is appropriate for the cap design in which it is employed. For example, the grommet 14 may be of rubber or plastic and have a diameter of $\frac{1}{4}$ to $\frac{5}{8}$ of an inch. The larger grommets are provided with a male snap connector 55 which will releaseably engage the aperture 53 in the loop portion 50. Note that the male snap connector is a conventional-type connector and when fixed to the grommet will compress the sides of the tubular grommet together as seen in FIG. 4. When the connector is engaged, the stay 17 will maintain the frame 12 and grommet 14 in suitable spaced relation.

The grommet 14 may be made from a thin resilient flat wire having a width, for example, of 1/16 to $\frac{3}{8}$ of an inch. In FIG. 5, the wire grommet **14*a* is too small to fix a snap connector thereto. However, the grommet 14*a* is connected to the stay 17 by inserting the grommet 14*a* through the slot 51 defined by the loop portion 50. The grommet 14*a*** is, of course, open when inserted, but joined together to complete the assembly.

As shown in FIGS. 6 and 7, in a cap having a high top, the grommet **14*b* is spaced above the stay 17, but is connected thereto by a loop of material 58, such as leather, which is wrapped about the grommet 14*b* and extends downwardly and carries a male snap connector 55*a* which is engaged with the aperture 53 of the loop portion 50**.

In FIG. 8, a male connector, shown in phantom and designated 60, is fixed to the loop portion 50. Consequently, the grommet (not shown) may carry a female connector which mates with the male connector 60 to provide an alternative construction.

Thus a stay of predetermined size is capable of functioning in uniform caps having differing dimensions and components. The stay may be used with caps having a tall cover, or with caps employing grommets of any size. The releasable connection between the stay 17 and the holder 16 and between the stay 17 and the grommet 14 permit the stay to be removed when desired to facilitate cleaning of the hat or replacement of the stay 17 or grommet 14.

I claim:

1. In a uniform cap having a frame, a flexible cover adapted to be fitted over said frame, a resilient grommet within said cover extending peripherally at the top thereof to exert outward pressure thereon, a holder secured adjacent the front of said frame defining an upwardly opening slot, and an upstanding support member of molded plastic material, the support member having a connecting portion removably received in the holder slot, the improvement comprising:

a loop portion extending rearwardly adjacent the top edge of said support member defining a slot, said loop portion having releasable connector means for engaging cooperating connector means, said support member allowing the grommet to be joined to said loop portion by cooperating connector means carried by said grommet and engage with said releasable connector means, and a strap carried by said grommet, said strap in turn carrying said cooperating connector means adapted to engage said releasable connector means.

* * * * *